US005527036A

United States Patent [19]

Hutchings et al.

[11] Patent Number: 5,527,036

[45] Date of Patent: Jun. 18, 1996

[54] GOLF SWING TRAINER

[76] Inventors: Thomas J. Hutchings, 24641 Stonegate Dr., West Hills, Calif. 91304; Tae W. Hahn, 20055 Hiawatha St., Chatsworth, Calif. 91311

[21] Appl. No.: 366,888

[22] Filed: Dec. 30, 1994

[51] Int. Cl.[6] ..... A63B 69/36

[52] U.S. Cl. ..... 473/220; 473/222; 473/268

[58] Field of Search ..... 273/183.1, 186.1, 273/186.2

[56] References Cited

U.S. PATENT DOCUMENTS

| | | | |
|---|---|---|---|
| 2,571,974 | 10/1951 | Walker | 273/186.1 |
| 2,787,470 | 4/1957 | Barrus et al. | 273/186.1 |
| 2,825,569 | 3/1958 | Alvarez | 273/186.1 |
| 3,009,704 | 11/1961 | Heard | 273/186.1 X |
| 3,107,920 | 10/1963 | Strunk | 273/186.1 |
| 3,601,408 | 8/1971 | Wright | 273/186.1 |
| 3,649,029 | 3/1972 | Worrell | 273/186.1 |
| 3,753,564 | 8/1973 | Brandell | 273/186.1 |
| 4,108,441 | 8/1978 | Tredway, Sr. | 273/186.1 |
| 4,251,077 | 2/1981 | Pelz et al. | 273/186.2 |
| 4,306,722 | 12/1981 | Rusnak | 273/186.1 |
| 4,306,723 | 12/1981 | Rusnak | 273/186.1 |
| 4,327,918 | 5/1982 | Foster | 273/186.1 |
| 4,341,384 | 7/1982 | Thackrey | 273/186.1 |
| 4,477,079 | 10/1984 | White | 273/186.1 |
| 4,630,829 | 12/1986 | White | 273/186.1 |
| 4,805,913 | 2/1989 | Bott | 273/186.1 |
| 4,826,174 | 5/1989 | Hoyt, Jr. | 273/186.1 |
| 4,971,328 | 11/1990 | Hernberg | 273/186.1 |
| 4,979,745 | 12/1990 | Kobayashi | 273/186.1 |
| 5,082,282 | 1/1992 | Hernberg | 273/186.1 |
| 5,114,150 | 5/1992 | Matsumura | 273/186.1 |
| 5,230,512 | 7/1993 | Tattershall | 273/186.1 |

*Primary Examiner*—William H. Grieb

[57] ABSTRACT

An electro-optic device is used to detect the position and speed of a golf club head as it passes in front of the device. This information triggers a short optical pulse of light to illuminate the club head, allowing a golfer to see the club head at a desired position as an after-image, and to read the displayed club head speed.

14 Claims, 2 Drawing Sheets

GOLF SWING TRAINER

BACKGROUND OF THE INVENTION

1. Field of the Invention

This invention pertains to a training device for golfers, and is particularly useful for improving the golfer's swing at the point where the club head strikes the ball. This device allows a golfer to see the club head position at this point.

2. Description of the Prior Art

There have been many attempts to develop devices to assist a golfer in improving the golf swing. Many books discuss the physical movements, positions and muscle sensations during the swing. None allows a golfer to see or to visualize what happens at the point where a club head strikes a ball. A golfer can see the flight of the ball after he/she swings, and try to infer what happened in hindsight. The golfer actually sees the club head only as a blur, however, because the club head is moving too fast to be seen clearly at the point of impact.

Devices such as accelerometers attached to a club, and pivots built into a club shaft, do not tell a golfer what a club head is doing at the point of ball contact. High speed video cameras are of limited use to golfers. Many golfers cannot remember their feelings or movements during a swing. Other devices use a club head detection system to illuminate a set of displays after a swing has been made. These devices do not allow the golfer to see what the club head was doing during the swing.

SUMMARY OF INVENTION

The electro-optic golf swing trainer of this invention helps a golfer to see the club head when it strikes the ball during a swing. The trainer provides a first image of the club head at the impact point and a second image an instant later. These images give the golfer immediate feedback so that the golfer can hit a ball more consistently. The device also focuses a golfer's attention at ball position through the hitting period.

The golf club head is detected electro-optically by the trainer as the head approaches the desired contact point. A high-intensity, short duration light pulse is emitted which illuminates the club head, creating an after-image of the club head for a time sufficient to determine the club head position. In preferred embodiments, a second high intensity light pulse is emitted which illuminates the club head a second time, creating a second after-image of the club head. The user sees these two images at a desired point, namely, promptly after the club head's contact with the ball. The user can immediately determine, from these images, golf club head position, rotation rate about the shaft axis, swing plane, relative speed, etc. An additional display on the device indicates the actual speed of each swing immediately after the club moves through the hitting zone. The user can adjust succeeding swings accordingly. The trainer works well for studying all golf strokes: putting, short swings and full swings.

BRIEF DESCRIPTION OF THE DRAWINGS

This invention can better be understood by reference to the drawings, in which.

BRIEF DESCRIPTION OF THE DRAWINGS

DESCRIPTION OF THE PREFERRED EMBODIMENT

Figure 1:
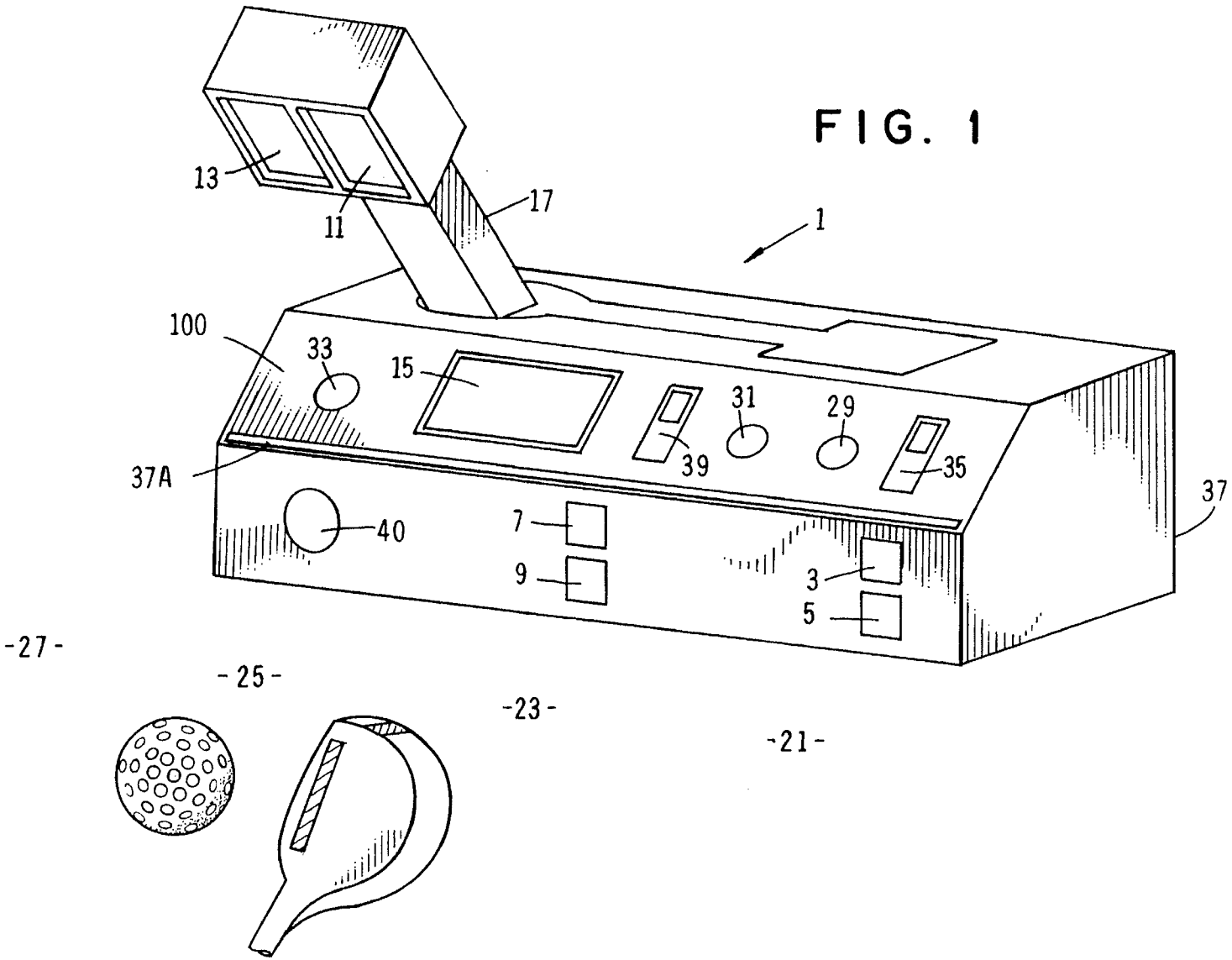
FIG. 1 shows a schematic drawing of the preferred embodiment of the golf swing trainer of this invention.

FIG. 1 shows trainer 1 for a right-handed golfer. Such a golfer swings a golf club from the right hand front side of trainer 1 to the left hand front side. During the swing, the club head passes the optical components on the front of trainer 1. These components, from right to left, are: first optical illumination source 3, first optical detector 5, second optical illumination source 7, second optical detector 9, first light pulse source 11, and second light pulse source 13. Also on the front side is digital display 15. Light pulse sources 11 and 13 are located on extendable member 17.

Multiple golf club head positions 21, 23, 25, and 27 illustrate the operation of trainer 1. Checkout light indicators 29 and 31, and "light pulser ready" indicator light 33 verify operability of the electro-optic detector circuits and logic. Trainer 1 also includes on-off switch 35 and a battery access door 37 on the rear panel.

In FIG. 1, a portion of the front top of the trainer i has an angled bezel 100 for holding the speed digital indicator, the position detector indicator lights and the on-off switch. The angle of bezel 100 allows a user to see the readouts more easily.

A white stripe 37A is located along the bezel edge adjacent to the vertical front panel as a reference line. In operation, a user places the ball opposite ball marker 40, preferably about two to six inches away, and swings the golf club such that it passes in front of trainer 1. When the club head reaches position 21, the club head is illuminated by source 3. A reflected signal from the club head is detected by detector 5. The photocurrent signal generated by the detector 5 triggers a logic circuit, which starts an incremental time counter and illuminates indicator light 29.

When the club reaches position 23, second light source 7 illuminates the club head. The resulting reflected light is detected by photodetector 9. This detected signal stops the time counter, turns on indicator light 31, triggers the start of a time delay, which is set by the logic and circuitry (see FIG. 2) to be a function of the club speed as determined by the measured time counter, and activates a circuit for firing a first light pulse. The first illumination pulse is emitted from source 11. After a second time delay, a second illumination pulse is emitted from source 13, and activates a circuit for firing a second light pulse after a second time delay (see FIG. 2, box 41).

By using the time counter information, the electronics logic generates signals to drive the digital display and indicate the speed. The speed is determined by measuring the time for the club head to pass from the first detection point to the second. The logic uses the measured time and a look-up table to determine the speed. The speed is displayed on digital display 15.

Switch 39 permits a user the option of selecting a reduced speed range for a putting stroke. Closing switch 39 divides the logic circuits of the counter down by a predetermined amount, e.g. one decade.

Before the user swings, the trainer's circuits are active, but the logic and time delays prevent the pulse illumination units from actuating, even when the user waggles the club head. During this period, circuit activation is monitored by light sources 29 and 31. Sources 29 and 31 aid in assuring that the club head is sufficiently close to the trainer to cause the detection circuits to function properly. Sources 29 and 31 are lighted when the respective detector detects a club head. When the user swings, both indicator lights are on, indicating that both detection circuits are functioning properly.

The addition of a small strip of reflectorized plastic tape with an adhesive back (3M Diamond Lite) to the toe of a club enhances the signal reflected to the detector, and is preferred, especially where the club is dark-colored. Reflected light increases by a factor of 5 to 10 with such a reflector. Such reflectors also allow a club head to be detected at a greater distance from the trainer. A reflector on the club head also increases the intensity of the after-image that a user sees. In FIG. 1, the reflector shown at club position 25 permits a user to see the angular orientation of a club more easily.

FIG. 1 shows the two light pulse sources 11, 13 attached to adjustable member 17. When member 17 is in the closed or retracted position, the sources lie within the trainer's boundary with the other components. Preferably, these sources are higher than the top of the club to enhance the illumination and visibility of the club head to the user. For this reason, the sources can preferably be moved outwardly and upwardly, and aimed downwardly toward the top surface of the club head.

A white line 37A is also illuminated by the pulse lights and serves as a reference line to aid in determining the direction and angular orientation of the club head.

Figure 2:
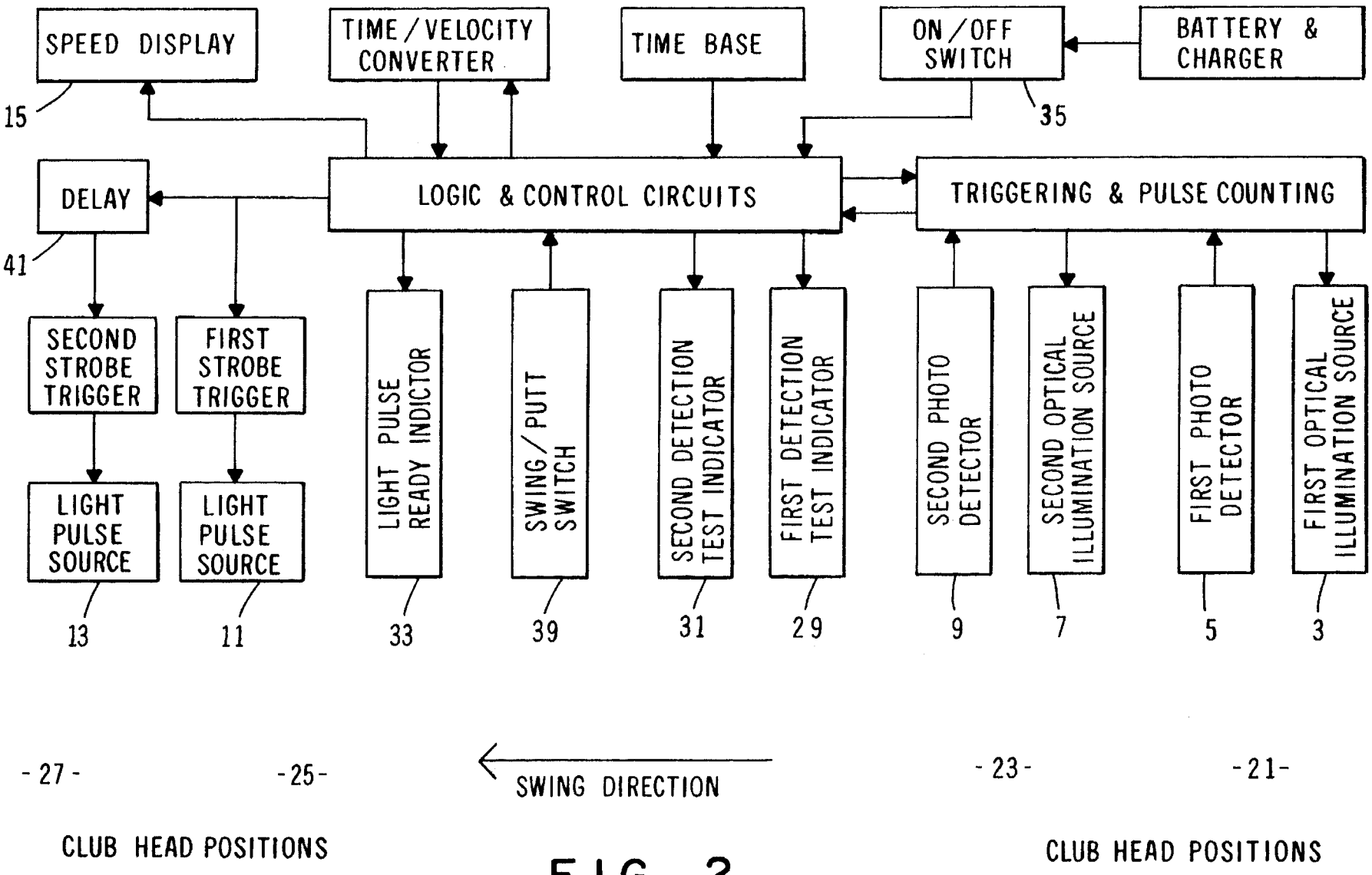
FIG. 2 shows a functional block diagram of the golf swing trainer embodiment depicted in FIG. 1.

FIG. 2 shows a functional block diagram of the electro-optical swing trainer 1. The first optical illumination source is a light emitting diode (Type 1N6264 from Harris) operated in a pulsed, low-duty cycle mode. The pulse current drive mode delivers a short, high optical power pulse of light to be emitted. Pulse rates are selected such that accurate determination of the club head position results, e.g. 50 KHz. A standard photodiode detector (UDT PIN_40A) is used for detection of the reflected signal. This signal initiates logic and starts a counter.

The second illumination source and detector operates in the same manner to generate a signal to stop the counter, initiate the logic to determine the speed of the club head in the time-to-speed converter and run the speed display. This also starts the delay and trigger circuits for the first and second light pulse sources which are then activated or fired. A typical light source could be a Xenon Flash Lamp (Type MFT 3227 from Tec/West USA Inc) similar to those used in the camera industry. The "flash ready" indicator light indicates when the flash system is ready to be flashed. The "detector function" indicator light is illuminated when the club head position detection system is functioning correctly. A typical time interval between the two pulses is 2–3 millisecs.

Trainer 1 can be adapted for use by a left-handed person. For example, trainer 1 can be configured so that, when inverted, the trainer's illuminating sources and detectors are arrayed from left to right instead of from right to left. Trainer 1 can be battery-operated or have a low-voltage supply. Laser diode arrays or light-emitting diode arrays can be used instead of the pulsed-flash unit. Such arrays better convert battery power to optical power for illumination of a golf club head. An LED optimal color for peak eye response is in the yellow color region. The preferred pulse illumination number is two to yield two illuminated positions of a club head. Alternatively, 1, 3 or more illuminated positions can be provided. To that end, the device includes additional arrays, or the array fires several times. The digital display may also include a ready indicator, memory to record the speed of many swings and to compute average speeds.

Concentration is increased with the trainer of this invention. A user need not look up as the pertinent information is at the point where the club hits the ball.

While there have hereinbefore been presented what are at present considered to be a preferred embodiment of the trainer, it will be apparent to those skilled in the art that many modifications and variations may be made therefrom without departing from the spirit and scope of the invention. All such variations and modifications, therefore, are considered to be a part of the invention, as set forth in the claims below.

What is claimed is:

1. A golf swing trainer device comprises:

a housing that includes a front surface having, near one end, a first light-emitting source and, adjacent thereto, and within said housing and on said front surface, a first reflected light detector;

spaced a predetermined distance on said surface from said first light-emitting source and first reflected light detector, a second light-emitting source within said housing and on said front surface and, adjacent thereto, a second reflected light detector within said housing and on said front surface;

connected to said first light-emitting source and said first reflected light detector and to said second light-emitting source and said second reflected light detector, circuitry for determining the time required for the head of a golf club, swung by a user, to traverse said predetermined distance and for determining the speed of said head over said predetermined distance; and spaced from said second light-emitting source and said second reflected light detector on said surface, at least two bright light emitters, each connected to said circuitry, said circuitry causing said first light-emitting source to illuminate said head as said head passes through the area illuminated by light from said first light-emitting source, said circuitry also initiating a time delay based upon the speed at which said club head moves between said first and said second light detector following illumination of said head by said first light-emitting source, said circuitry, following the end of said time delay, causing said second light-emitting source to illuminate said head as said head passes through the area illuminated by light from said second light emitting source, whereby a user can see said head when said head strikes a ball in one of said areas and promptly after said head strikes said ball in another of said areas.

2. The golf swing trainer device of claim 1 wherein said circuitry prevents emission of light from said first light-emitting source and from said second light-emitting source when a user is waggling the head of a golf club within the detection range of said device in preparation for a full swing at said ball.

3. A golf swing trainer device comprises:

a housing that includes a front surface having, near one end, a first light-emitting source and, adjacent thereto, and within said housing and on said front surface, a first reflected light detector;

spaced a predetermined distance on said surface from said first light-emitting source and first reflected light detector, a second light-emitting source within said housing and on said front surface and, adjacent thereto, a second reflected light detector within said housing and on said front surface; and connected to said first light-emitting source and said first reflected light detector and to said second light-emitting source and said second reflected light detector, circuitry for operating said first light-emitting source, said first reflected light detector, said second light-emitting source, and said second reflected light detector;

spaced from said second light-emitting source and said second reflected light detector on said surface, at least two bright light emitters, each connected to said circuitry, said circuitry causing said first light-emitting source to illuminate said head as said head passes through the area illuminated by light from said first light-emitting source, said circuitry also initiating a time delay based upon the speed at which said club head moves between said first and said second light detector following illumination of said head by said first light-emitting source, said circuitry, following the end of said time delay, causing said second light-emitting source to illuminate said head as said head passes through the area illuminated by light from said second light emitting source, whereby a user can see said head when said head strikes a ball in one of said areas and promptly after said head strikes said ball in another of said areas.

4. The golf swing trainer device of claim 3 further comprising first and second short duration, bright light emitters, each connected to circuitry that causes each of said emitters to emit sufficient light to illuminate the head of a golf club, swung by a user, as said head passes through the area illuminated by light from each of said emitters, whereby a user can see said head when said head strikes a golf ball in one of said areas, and, promptly thereafter, can see said head immediately after said head strikes said golf ball.

5. The golf swing trainer of claim 4 wherein said circuitry prevents emission of light from said first light-emitting source and from said second light-emitting source when a user is waggling the head of a golf club within the detection range of said device in preparation for a full swing at said ball.

6. The golf swing trainer device of claim 5 further comprising an extendible, retractable support for each of said short duration, bright light emitters.

7. The golf swing trainer device of claim 5 further comprising, on the surface of said device by which said head passes, a reference direction line, and a golf ball position marker.

8. The golf swing trainer device of claim 5 wherein each of said at least one short duration, bright light emitters is an array of LEDs or at least one laser diode.

9. The golf swing trainer device of claim 4 further comprising an extendible, retractable support for each of said short duration, bright light emitters.

10. The golf swing trainer device of claim 4 further comprising, on the surface of said device by which said head passes, a reference direction line, and a golf ball position marker.

11. The golf swing trainer device of claim 4 wherein each of said at least one short duration, bright light emitters is an array of LEDs or at least one laser diode.

12. The golf swing trainer device of claim 3 further comprising an extendible, retractable support for each of said short duration, bright light emitters.

13. The golf swing trainer device of claim 3 further comprising, on the surface of said device by which said head passes, a reference direction line, and a golf ball position marker.

14. The golf swing trainer device of claim 3 wherein each of said at least one short duration, bright light emitters is an array of LEDs or at least one laser diode.

* * * * *